US006471912B2

(12) United States Patent
Heggseth et al.

(10) Patent No.: US 6,471,912 B2
(45) Date of Patent: Oct. 29, 2002

(54) ROTOR FOR THE TREATMENT OF A FLUID SUCH AS A METAL MELT

(75) Inventors: Bjarne Heggseth, Kristiansund (NO); John Olav Fagerli, Sunndalsøra (NO); Eddy Steinar Dale, Ålvundeid (NO); Per Gunnar Strand, Sunndalsøra (NO); Karl Venås, Saupstad (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 09/789,815

(22) Filed: Feb. 22, 2001

(65) Prior Publication Data

US 2001/0017434 A1 Aug. 30, 2001

(30) Foreign Application Priority Data

Feb. 25, 2000 (NO) ..... 20000974

(51) Int. Cl.[7] ..... C22B 9/05; C22B 9/10

(52) U.S. Cl. ..... 266/216; 266/218; 266/235; 266/275

(58) Field of Search ..... 266/204, 233, 266/235, 216, 218, 275

(56) References Cited

FOREIGN PATENT DOCUMENTS

EP 0 151 434 * 8/1985

* cited by examiner

*Primary Examiner*—Melvyn Andrews
(74) *Attorney, Agent, or Firm*—Wenderoth, Lind & Ponack, L.L.P.

(57) ABSTRACT

A device in connection with a rotor (9) for the treatment of a liquid such as molten metal in a reactor (20) or similar structure. Gas and/or particulate material is supplied to the liquid, preferably via the rotor shaft (8) and through openings (18) from a cavity (16) in the rotor. The rotor shaft (8) extends up through the base of the reactor (20) and is arranged so that it may rotate inside a stator pipe (3) which extends up from the base of the reactor. The rotor shaft and the stator pipe extend through an opening (21) in the lower side of the rotor (9) and into the cavity (16) in the rotor. Expediently, the rotor shaft (8) is connected to the rotor (9) via a fixing device (13) inside the rotor cavity, while the stator pipe (3) ends in the cavity (16).

12 Claims, 1 Drawing Sheet

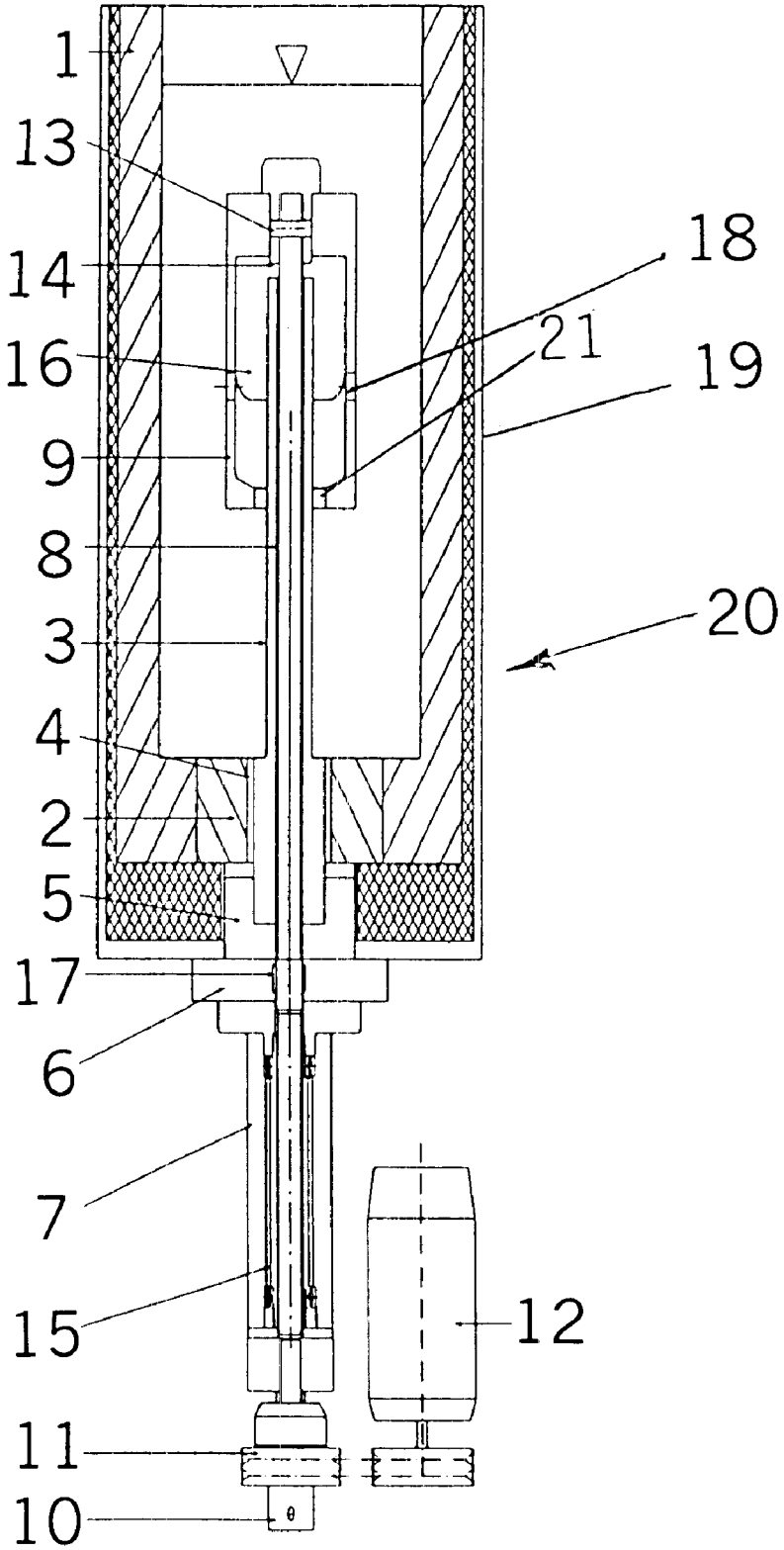
1
13
14
16
9
8
3
4
2
5
17
6
7
15
11
10
18
21
19
20
12

ROTOR FOR THE TREATMENT OF A FLUID SUCH AS A METAL MELT

BACKGROUND OF THE INVENTION

1. Field of the Invention

The present invention concerns a device in connection with a rotor for the treatment of a liquid such as molten metal.

2. Description of Related Art

Most systems for the treatment of, for example, molten metal with gas are based on the principle of supplying the gas to and dispersing the gas in the molten metal using a rotor. An example of such a rotor is shown and described in the applicant's own European patent no. 0151434, in which the gas is supplied via a drilled hole in the rotor shaft of the rotor, which consists of a hollow, cylindrical rotating body, and in which the gas is supplied to and dispersed in the liquid (molten metal) via holes in the rotating body.

One disadvantage of this and other prior art rotor solutions is that the rotor and rotor shaft extend down into the liquid from above via holes in the roof of the reactor chamber. The electric motor, which drives the rotor, is either fixed to the top of the reactor or fixed to a column connected to the reactor on a separate hoist system.

In terms of liquid treatment, it is disadvantageous that the shaft extends down into the liquid from above as a vortex is formed around the shaft when it rotates. Impurities and slag which are separated from the metal float up to the surface but will easily be drawn back into the metal via this vortex. Moreover, the greatest wear on the shaft occurs in the area between air and metal, i.e. in the vortex area.

SUMMARY OF THE INVENTION

The present invention represents a solution in connection with a rotor in which the above disadvantages are eliminated. The present invention is characterized in that the rotor shaft extends up through the base of the reactor and is arranged so that it may rotate inside a stator pipe which is fixed to and extends up from the base of the reactor. The rotor shaft and the stator pipe extend through an opening in the lower side of the rotor and into the cavity in the rotor. The rotor shaft is connected to the rotor via a fixing device inside the rotor cavity, while the stator pipe ends in the cavity.

BRIEF DESCRIPTION OF THE DRAWING

The FIGURE is a cross-sectional view of a reactor or treatment vessel constructed in accordance with the present invention.

DETAILED DESCRIPTION OF THE INVENTION

The present invention will be described in further detail using examples and with reference to the attached drawing, which shows a reactor or treatment vessel or container 20 for the treatment of molten mass, involving the use of a rotor 9. A reactor jacket 19 itself may expediently be produced from a suitable steel material. The steel jacket 19 is lined on the inside with fireproof material 1.

A molded brick 2 is embedded in the reactor's base lining 1. A stator pipe 3 with a seal 4, which forms a seal between the molded brick 2 and the stator pipe 3, is inserted from the bottom of the reactor. The stator pipe 3 is made of a fireproof, insulating material which is resistant to the molten mass and has a given thermal conductivity. The stator pipe is guided vertically and horizontally by a collar 5 which is made of an insulating material.

The collar is located on a steel flange 6 which is bolted to the bottom of the reactor jacket. This creates a prestress on the seal 4 which is located between the stator pipe 3 and molded brick 2. This prestress is important for the absorption of differences in thermal expansion and shrinkage between the various materials. The bearing support 7 for the rotor shaft 8 is mounted against the steel flange 6. The bearings are cooled using forced air cooling. The drive shaft 8 of the rotor 9 is inserted down into the stator pipe from the top and ends in a quick-action coupling 10 in the bearing support. A belt pulley 11 driven via an electric motor 12 is located above the quick-action coupling.

The rotor 9 is of the same type as that shown and described in the applicant's own European patent no. 0151434, which is hollow inside and has an opening 21 at the bottom end and holes 18 in the sides. The rotor is fixed to the drive shaft at the top, expediently via, for example, a thread connection or a carrier arrangement in the form of a cotter or bolt connection. The stator pipe 3 extends from the base of the reactor through the hole in the base of the rotor 9 and into the cavity in the rotor with a certain clearance to the internal top surface 14 of the rotor.

When treating a molten mass or filling the reactor with it, an air/gas pocket is formed in the upper part of the cavity 16 in the rotor so that no molten mass can flow down into the annulus between the shaft 8 and the stator pipe 3. The rotor otherwise works in the same way as that described in the applicant's above European patent; the molten mass is drawn up through the hole 21 in the base of the rotor by means of the rotation of the rotor 9 and is pressed (slung) out through the holes 18 in the side by means of centrifugal force.

Gas and/or particulate material for the treatment of the liquid may expediently be supplied through a drilled hole in the rotor shaft (not shown in further detail) or through the annulus between the shaft and the stator pipe. Alternatively, gas may be supplied via a drilled hole in the shaft and any surplus gas may be returned through the above-described annulus. The reactor may also be fitted with a lid (not shown in further detail) so that the molten mass may be treated in a closed system, for example under an inert atmosphere. It should be noted that the invention, as it is defined in the claims, is not restricted to the embodiment shown in the figure or described above. Hence, the rotor with the embodiment shown may be used to treat liquids other than molten metal, for example suspensions such as sewage or other types of contaminated water.

The solution here described avoids, as stated above, the formation of a vortex and wear on the rotor shaft as it is not in direct contact with the molten mass.

Another major advantage of there not being such contact is that it is possible to use metallic materials in the shaft which are considerably stronger and less expensive and which have a longer life than the materials now used.

Still another major advantage of the use of a stator pipe which ends in an air pocket in the rotor is that there is no need for expensive seals which would otherwise be necessary if the shaft had extended through the base without the stator pipe.

What is claimed is:

1. A device for treatment of a liquid by supplying gas and/or particulate material, said device comprising:

a reactor having a base;

a stator pipe extending up from the base of said reactor;

a rotor shaft extending up through the base of said reactor and into said stator pipe so that said rotor shaft can rotate inside of said stator pipe;

a rotor mounted on an end of said rotor shaft via a fixing device, said rotor defining a lower opening, an interior cavity and at least one through hole communicating the interior cavity of said rotor with an interior of said reactor, wherein said rotor shaft and said stator extend through the lower opening and into the rotor cavity, and wherein a first end of said stator pipe is disposed in the rotor cavity.

2. The liquid treatment device as claimed in claim 1, wherein said shaft is directly connected to said rotor by means of a threaded connection, cotter or bolt connection.

3. The liquid treatment device as claimed in claims 1, wherein gas and/or particulate material can be supplied to the rotor cavity via a hole in said rotor shaft or via an annular space between said shaft and said stator pipe.

4. The liquid treatment device as claimed in claim 3, wherein said rotor shaft and said stator pipe are arranged so that an annular space is formed between an interior peripheral surface of said stator pipe and an outer peripheral surface of said rotor shaft.

5. The liquid treatment device as claimed in claim 1, wherein said rotor shaft and said stator pipe are arranged so that an annular space is formed between an interior peripheral surface of said stator pipe and an outer peripheral surface of said rotor shaft.

6. A molten metal treatment device comprising:

a vessel having a bottom;

a brick embedded in the bottom of said vessel;

a pipe extending through said brick and into said vessel, wherein said pipe is formed of a fireproof insulating material;

a drive shaft inserted into said pipe; and a rotor disposed in said vessel and fixed to a first end of said drive shaft, said rotor having a bottom opening, an interior cavity, and a plurality of through holes formed in a side wall of said rotor, wherein said pipe extends through the bottom opening of said rotor and into the interior cavity.

7. The molten metal treatment device as claimed in claim 6, wherein the upper end of said pipe is spaced from an upper interior surface of said rotor.

8. The molten metal treatment device as claimed in claim 7, wherein an outer peripheral surface of said pipe is spaced from said rotor at the bottom opening so that molten metal can be drawn up into the interior cavity upon rotation of said rotor.

9. The molten metal treatment device as claimed in claim 6, further comprising:

a collar connected to the bottom of said vessel, wherein said pipe extends through said collar; and a seal disposed between said brick and said pipe, wherein the connection of said collar to said vessel pre-stresses said seal.

10. The molten metal treatment device as claimed in claim 6, wherein said shaft is directly connected to said rotor.

11. The molten metal treatment device as claimed in claim 6, wherein gas and/or particulate material can be supplied to the rotor cavity via a hole in said rotor shaft or via an annular space between said shaft and said pipe.

12. The molten metal treatment device as claimed in claim 6, wherein said rotor shaft and said pipe are arranged so that an annular space is formed between an interior peripheral surface of said pipe and an outer peripheral surface of said rotor shaft.

* * * * *